United States Patent [19]

MacLean et al.

[11] Patent Number: 4,474,192

[45] Date of Patent: Oct. 2, 1984

[54] CIGARETTES

[75] Inventors: Kenneth J. H. MacLean, Southampton; Michael J. Ward, Eastleigh, both of England

[73] Assignee: Brown & Williamson Tobacco Corporation, Louisville, Ky.

[21] Appl. No.: 404,067

[22] Filed: Aug. 2, 1982

[30] Foreign Application Priority Data

Aug. 3, 1981 [GB] United Kingdom ..... 8123698

[51] Int. Cl.[3] ..... A24D 3/04

[52] U.S. Cl. ..... 131/336; 131/338; 131/339

[58] Field of Search ..... 131/365, 336, 338, 339, 131/340, 360, 361

[56] References Cited

U.S. PATENT DOCUMENTS 4,135,523 1/1979 Luke et al. ..... 131/336

4,380,241 4/1983 Horsewell et al. ..... 131/336

*Primary Examiner*—V. Millin

*Attorney, Agent, or Firm*—Charles G. Lamb

[57] ABSTRACT

A cigarette comprises a cigarette rod of smokable material enwrapped in a cigarette wrapper and a filter tip attached at one end of said rod by means of a tipping wrapper, which tip comprises smoke-filtration means and is provided at its periphery with at least one groove extending to the mouth end of the tip, the cigarette wrapper, at the region adjacent the tip, being depressed inwardly to provide at least one cavity which is in communication with at least one groove and that portion of the tipping wrapper which overlies the cavity permitting ingress of air into the same. The cigarette wrapper may be of heat-deformable paper and may comprise a proportion of thermoplastic fibres or filaments. The tipping wrapper may extend to the mouth end of the tip. The cavity may comprise at least one annular groove in the said cigarette rod or may be formed by a drawing down of the cross section of the rod, to provide an annular cavity, by means of an additional wrapper of heat-deformable or heat-shrink material.

8 Claims, 9 Drawing Figures

CIGARETTES

This invention relates to ventilated filter-tipped cigarettes.

It is known to provide cigarettes with filters comprising smoke-filtration means, commonly in the form of a plug of fibrous filtration material, and ventilation-passage means extending to the mouth end of the filter, the outer wrapper enwrapping the filter being such as to permit ingress of air into the passage means. When a cigarette provided with such a filter is smoked, air wholly or substantially unmixed with tobacco smoke enters the smoker's mouth from the passage means together with tobacco smoke from the filtration means. It has been found that the segregation of air and smoke in this manner enhances the smoking characteristics of the cigarette.

A problem for the cigarette manufacturer in ensuring that the smoker obtains the benefit derivable from a segregated-ventilation filter is that, in holding the cigarette at the tip end, the smoker may obturate the ventilation means provided in the outer wrapper of the filter, thus reducing or preventing the ingress of air into the passage means. It is an object of the present invention to provide a cigarette having a segregated ventilation filter wherein the incidence of this problem is eliminated or at least significantly reduced.

The present invention provides a cigarette comprising a rod of smokable material enwrapped in a cigarette wrapper and a filter tip attached at one end of said rod by means of a tipping wrapper, said filter tip comprising smoke-filtration means and being provided at the periphery of the tip with at least one groove extending to the mouth end of said tip, said cigarette wrapper, at the region of the rod adjacent the tip, being deformed inwardly to provide at least one cavity, which cavity is in communication with at least one said groove, and that portion of said tipping wrapper overlying said cavity permitting ingress of air into said cavity.

The tipping wrapper may extend to the mouth end of the filter tip or it may have the form of a comparatively narrow tipping band.

The cavity formed by deformation of the cigarette paper may take the form of one or more grooves or it may be provided by drawing down the cross-section of the cigarette rod, suitably in uniform manner, so as to provide an annular cavity.

Preferably the cigarette paper is heat-deformable. For this purpose it may comprise a proportion, advantageously not less than 50%, of thermoplastic fibres or filaments. If the cigarette paper used in of orthodox, non-heat deformable, type, as end zone thereof may be rendered heat-deformable by for example the application at said zone of a suitable material. Thus, for example, there may be applied over the zone an additional weapper of heat deformable material. Alternatively the end zone of the cigarette paper may be coated or impregnated with a material rendering the zone heat-deformable. The cigarette paper may be heat deformable in the sense that by the application of heat thereto the cavity may be obtained by thermally setting the cigarette paper in the requisite conformation. Alternatively it may be heat deformable in the sense of having the property of shrinking when subjected to a sufficient degree of heating.

It is also conceivable to set a required deformation in the cigarette paper by the application thereto of an impregnant in a volatile vehicle.

In order that the invention may be clearly understood and readily carried into effect, reference will now be made, by way of example, to the accompanying diagrammatic drawings, in which.

Figure 1:
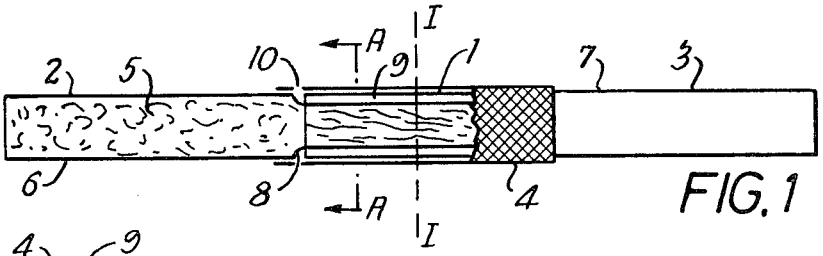
FIG. 1 shows a double-length filter-tipped cigarette, partly in axial cross-section.
Figure 2:
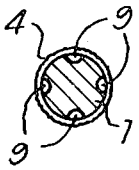
FIG. 2 shows a cross-sectional view taken at A—A of FIG. 1.

The double cigarette of FIGS. 1 and 2 comprises a double unit length filter plug 1, first and second cigarette rods 2 and 3, and a paper tipping wrapper 4 serving to interattach the plug 1 and the cigarette rods 2, 3. Each of the cigarette rods 2, 3 comprises a filter of smokable material (that of the rod 2 being designated by reference numeral 5) enwrapped in a heat deformable, low air-permeability paper wrapper 6, 7 formed of an 80:20 by weight mixture of polyethylene and cellulose fibres.

Prior to their assembly with the filter plug 1, the cigarette rods 2, 3, at the ends thereof intended to abut the plug 1, are provided with annular half-grooves. Reference numeral 8 designates the annular half-groove formed at the end of rod 2. The peripheral conformation of the cigarette rods 2, 3 is modified to provide the annular half-grooves at the respective ends thereof by moving the rods 2, 3 in contact with heated forming means of appropriate shape whilst moving the rods in a direction transverse to their axes. In United Kingdom Patent Specification No. 1,507,765 there is described an apparatus suitable for shaping rods of smoke-filtering material. The apparatus comprises a drum-shaped inner rotor for supporting and conveying the rods and a heatable arcuate outer stator past which the rods may be carried by the rotor in a direction perpendicular to their axes while simultaneously being caused to rotate about their axes. An apparatus constructed and operable according to the same principle could be employed for forming the annular half-grooves at the inner ends of the cigarette rods 2, 3. Conveniently a full annular groove in formed at the mid point of a double length cigarette rod, which is then severed centrally of the groove to provide the rods 2, 3.

Prior to its having been assembled with the cigarette rods 2, 3, the filter plug 1, which is formed of cellulose acetate and has a self-bonded construction, is subjected to a forming process resulting in the provision of four equi-angularly spaced grooves 9 extending for the full length of the plug 1. The forming process may conveniently be performed on apparatus similar to that disclosed in the patent specification referred to above, but having heatable stator means extending parallel to the axis of the rotor. At the time that the filter plug 1 is subjected to the forming process it may constitute a portion of a rod the length of which is equivalent to a multiple of a double unit length plug, the rod being subsequently cut into the constituent double unit length plugs.

After the tipping wrapper 4 has been applied to the three element assembly of plug 1 and rods 2, 3, it is provided with two encircling rows of ventilation holes, one of which rows is designated by reference numeral 10, in register respectively with the annular half-groove 8 of the cigarette rod 2 and the corresponding groove at the inner end of the cigarette rod 3. The double length cigarette is then severed at the plane I—I to provide two completed individual cigarettes. When these cigarettes are smoked, ventilation air is drawn in through the ventilation holes into the annular half-groove and then passes along the filter plug grooves to the smoker's mouth, whereas the smoke from the cigarette rod passes through the interior of the filter plug.

As an alternative to a filter plug of self-bonded construction, a filter plug comprising a heat deformable plugwrap could be used in the double length cigarette of FIG. 1. Wrapped smoke-filter rods suitable for forming filter plugs similar to the filter plug 1 of FIG. 1 are disclosed in United Kingdom Patent Specification Nos. 2,056,841A and 2,058,543A.

Figure 3:
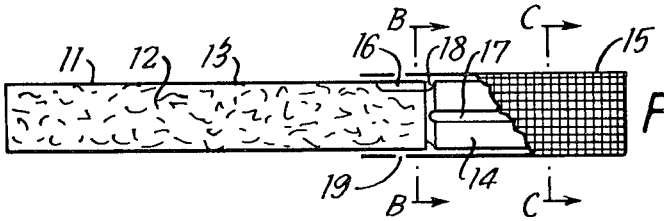
FIG. 3 shows a differently formed, single filter tipped cigarette, with the cigarette rod thereof in axial section and the filter portion depicted with the tipping wrapper partly removed.
Figure 4:
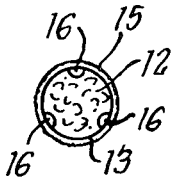
FIGS. 4 and 5 show respective cross-sectional views taken at B—B and C—C of FIG. 3.
Figure 5:
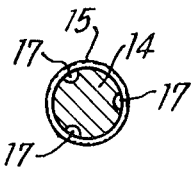

The cigarette diagrammatically depicted in FIGS. 3–5 comprises a cigarette rod 11, constituted by a filler 12 of smokable material enwrapped in a heat deformable paper wrapper 13 formed substantially wholly of polyethylene, and a filter plug 14, of self-bonded cellulose acetate fibres, secured to the rod 11 by means of a paper tipping wrapper 15. Before the rod 11 is assembled with the filter plug 14, three equi-angularly spaced grooves 16 are formed in the wrapper 13 by rolling the rod 11 in contact with a suitably shaped heated former means. As may be seen from FIG. 3, the grooves 16 extend longitudinally of the cigarette rod 11 from the end of the rod abutting the filter plug 14.

The filter plug 14 is provided, before assembly with the rod 11, with three equi-angularly spaced peripheral grooves 17 which extend from the mouth end of the plug 14 to an annular half-groove 18 formed at the opposite end of the plug 14.

After the paper tipping wrapper 15 has been applied to the juxtaposed filter plug 14 and cigarette rod 11, it is provided with a row of ventilation holes 19 overlying the grooves 16 formed in the cigarette rod 11, the arrangement being such that at least one hole communicates with each of the grooves 16. When a cigarette as depicted in FIG. 3 is smoked, ventilation air flows into the grooves 16 through the ventilation holes 19. The ventilation air flows from the grooves 16 via the annular groove 18 of the plug 14, to the groove 17 thereof and from there to the smoker's mouth.

Figure 7:
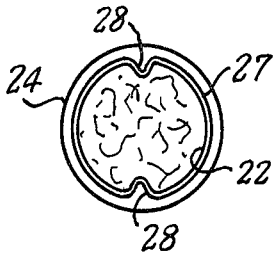
FIGS. 7 and 8 show respective cross-sectional views taken at D—D and E—E of FIG. 6.
Figure 8:
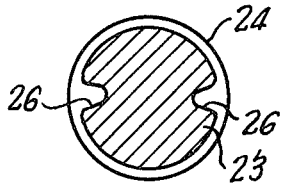
Figure 6:
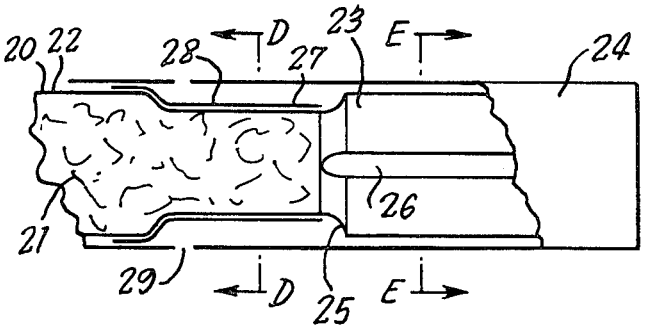
FIG. 6 shows, to a somewhat larger scale, part of a filter-tipped cigarette, with the cigarette rod thereof in axial section and the filter portion depicted with the tipping wrapper partly removed.

The cigarette of FIGS. 6–8 comprises a cigarette rod 20, constituted by a filler 21 of smokable material enwrapped in a cigarette wrapper 22 of conventional cigarette paper, and a filter plug 23, of self-bonded cellulose acetate fibres, secured to the rod 20 by means of a tipping wrapper 24.

The filter plug 23 is provided, at the end thereof abutting the cigarette rod 20, with an annular half-groove 25 and, at diametrically opposed locations, with grooves 26 which extend from the half-groove 25 to the mouth end of the plug 23.

Before being assembled with the filter plug 23, the cigarette rod 20 forms one half of a double length cigarette rod of plain cylindrical form. There is wrapped about a central zone of the double length cigarette rod a heat deformable wrapper one half of which appears in FIGS. 6 and 7 designated 27. The double length cigarette is then subjected to a hot forming process to provide, within the bounds of the central zone, two grooves 28 disposed at diametrically opposed locations, after which the double length rod is severed to provide two individual cigarette rods.

As will be appreciated, the provision of the heat deformable wrapper renders the rod heat deformable at the wrapped zone. Various thermoplastic materials may be used to provide the wrapper. A suitable such material is polyethylene.

The tipping wrapper 24 is provided with an encircling row of ventilation holes 29, at least one of which communicates with each of the grooves 20.

Figure 9:
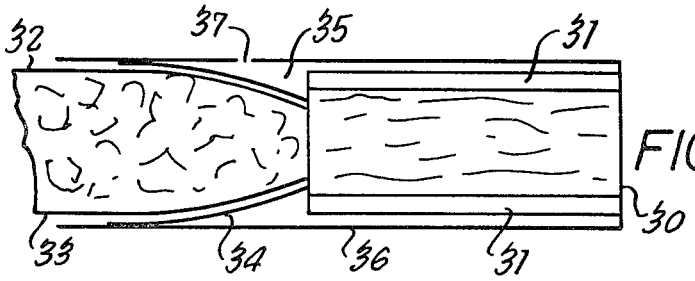
FIG. 9 is a view similar to that of FIG. 6 of a different form of cigarette.

In the cigarette of FIG. 9 the filter plug 30 is provided with four equi-angularly spaced grooves 31, which grooves extend from end-to-end of the plug 30. Instead of providing grooves in the surface of the cigarette rod 32, an approximately frusto-conical form is imparted to the end of the rod adjacent the plug 30. As in the case of the cigarette of FIG. 6, conventional cigarette paper 33 of the rod 32 is rendered heat deformable by the presence of an additional wrapper 34 of thermoplastic material. There is thus provided an annular cavity 35 in communication with the grooves 31 of the filter plug 30. Tipping 36 is provided with an encircling row of ventilation holes 37 in register with the cavity 35.

As an alternative to the additional wrapper 34 being of a thermoplastic nature, it may instead be of a heat-shrink material. The wrapper is applied to a double length cigarette rod and is then heated to cause it to shrink and thus to produce a waisted effect in the double rod, which is then severed at the mid plane to provide individual rods as per rod 32. A cigarette rod comprising a heat-shrink wrapper is disclosed in U.K. Patent Specification No. 1,378,145, but the wrapper is not pre-shrunk in that case.

What is claimed is:

1. A cigarette comprising a cigarette rod of smokable material enwrapped in a cigarette wrapper and a filter tip attached at one end of said rod by means of a tipping wrapper, said filter tip comprising smoke-filtration means and being provided at the periphery of the tip with at least one groove extending from said rod to the mouth end of said tip, said cigarette wrapper, at the region of the said rod adjacent the tip, being depressed inwardly to provide at least one cavity which is in flow communication with at least one said groove, and that portion of said tipping wrapper overlying said cavity permitting ingress of air into the same.

2. A cigarette according to claim 1, wherein the tipping wrapper extends to the mouth end of the filter tip.

3. A cigarette according to claim 1 or 2, wherein the said cavity comprises at least one annular groove in the said cigarette rod.

4. A cigarette according to claim 1, wherein the said cavity is formed by a drawinng down of the cross section of the cigarette rod to provide an annular cavity.

5. A cigarette according to claim 4, wherein the cross section of the cigarette rod is drawn down to provide the said cavity by means of an additional wrapper of heat-shrink material.

6. A cigarette according to claim 1, wherein the cigarette wrapper is of heat-deformable paper.

7. A cigarette according to claim 6, wherein the cigarette wrapper comprises a proportion of thermoplastic fibres or filaments.

8. A cigarette according to claim 1, wherein the cross section of the cigarette rod is drawn down to provide the said cavity by means of an additional wrapper of heat-deformable material.

* * * * *